US007909314B2

(12) United States Patent
Roesch et al.

(10) Patent No.: US 7,909,314 B2
(45) Date of Patent: Mar. 22, 2011

(54) DEVICE FOR EXTENDING THE CLAMPING WIDTH FOR A CLAMPING TOOL AND COMBINATION OF CLAMPING TOOL AND DEVICE FOR EXTENDING THE CLAMPING WIDTH

(75) Inventors: Hans Roesch, Gemmrigheim (DE); Gerhard Kloepfer, Pleidelsheim (DE); Michael Moesslein, Leonberg (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 432 days.

(21) Appl. No.: 12/218,225

(22) Filed: Jul. 10, 2008

(65) Prior Publication Data

US 2009/0026337 A1 Jan. 29, 2009

(30) Foreign Application Priority Data

Jul. 27, 2007 (DE) ..... 10 2007 036 406

(51) Int. Cl.
*B25B 1/00* (2006.01)

(52) U.S. Cl. ..... 269/6; 269/3; 269/166; 269/249

(58) Field of Classification Search ..... 269/3, 6, 269/32, 147–150, 165–171.5, 228, 249; 248/229.12, 248/229.22, 228.3, 230.3, 231.41
See application file for complete search history.

(56) References Cited

U.S. PATENT DOCUMENTS

| | | | | | |
|---|---|---|---|---|---|
| 669,282 | A * | 3/1901 | Lampher | 269/146 |
| 870,419 | A * | 11/1907 | Cyr | 269/147 |
| 1,093,438 | A * | 4/1914 | Krueck | 269/149 |
| 1,196,560 | A * | 8/1916 | Long | 269/89 |
| 1,269,262 | A * | 6/1918 | Crawford | 269/101 |
| 2,510,077 | A * | 6/1950 | Coffman | 269/166 |
| 3,159,127 | A * | 12/1964 | Wheeler | 269/3 |
| 4,555,100 | A * | 11/1985 | Ditto | 269/166 |
| 4,962,918 | A * | 10/1990 | Yang | 269/156 |
| 5,443,246 | A * | 8/1995 | Peterson | 269/283 |
| 5,568,915 | A * | 10/1996 | Raymond | 269/147 |
| 6,412,767 | B1 * | 7/2002 | Beckmann et al. | 269/166 |
| 6,474,632 | B1 * | 11/2002 | Liou | 269/6 |
| 6,708,966 | B1 * | 3/2004 | Troudt | 269/249 |
| 6,746,006 | B2 * | 6/2004 | Thomas | 269/6 |
| 6,971,641 | B1 * | 12/2005 | Sherwin | 269/166 |

(Continued)

FOREIGN PATENT DOCUMENTS

DE 10 2004 013 066 9/2005

(Continued)

OTHER PUBLICATIONS

U.S. Appl No. 11/690,636, filed Mar. 23, 2007, Chapman.

*Primary Examiner* — George Nguyen

(74) *Attorney, Agent, or Firm* — Lipsitz & McAllister, LLC

(57) ABSTRACT

Device for extending the clamping width for a clamping tool, comprising a first rail to which a first workpiece abutment element is fixed, a second rail to which a second workpiece abutment element is fixed, a first bracket on which the first rail and the second rail are mounted for sliding displacement, and a second bracket on which the first rail and the second rail are mounted for sliding displacement, wherein the first bracket and the second bracket serve for engagement of the clamping tool thereon.

40 Claims, 3 Drawing Sheets

U.S. PATENT DOCUMENTS

| | | | | |
|---|---|---|---|---|
| 7,066,457 | B2 * | 6/2006 | Gerritsen et al. | 269/6 |
| 7,325,797 | B2 | 2/2008 | Kloepfer et al. | |
| 7,546,691 | B2 * | 6/2009 | Mackey | 33/613 |
| 7,600,744 | B2 * | 10/2009 | Liou | 269/166 |
| 7,604,224 | B2 * | 10/2009 | Rowlay et al. | 269/6 |
| 2007/0057424 | A1 | 3/2007 | Kern | |
| 2007/0090580 | A1 * | 4/2007 | Fratianne | 269/6 |
| 2007/0222130 | A1 * | 9/2007 | Leinbach et al. | 269/6 |

FOREIGN PATENT DOCUMENTS

| | | | |
|---|---|---|---|
| EP | 354290 | A1 * | 2/1990 |
| EP | 000300009-0001-0008 | | 5/2005 |

* cited by examiner

DEVICE FOR EXTENDING THE CLAMPING WIDTH FOR A CLAMPING TOOL AND COMBINATION OF CLAMPING TOOL AND DEVICE FOR EXTENDING THE CLAMPING WIDTH

The present disclosure relates to the subject matter disclosed in German application number 10 2007 036 406.9 of Jul. 27, 2007, which is incorporated herein by reference in its entirety and for all purposes.

BACKGROUND OF THE INVENTION

The invention relates to a device for extending the clamping width for a clamping tool.

The invention further relates to a combination of clamping tool and device for extending the clamping width.

Commercially available clamping tools and, in particular, clamps such as screw clamps, lever clamps or one-hand-operable clamps usually have a clamping width which may be too small for certain applications.

SUMMARY OF THE INVENTION

In accordance with the present invention, a device for extending the clamping width for a clamping tool is provided, which allows the clamping width of the clamping tool to be increased.

In accordance with an embodiment of the invention, a first rail is provided, to which a first workpiece abutment element is fixed, a second rail is provided, to which a second workpiece abutment element is fixed, a first bracket is provided, on which the first rail and the second rail are mounted for sliding displacement, and a second bracket is provided, on which the first rail and the second rail are mounted for sliding displacement, and the first bracket and the second bracket serve for engagement of the clamping tool thereon.

The first bracket and the second bracket each provide bearings and, in particular, slide bearings for the displaceable mounting of the first rail and the second rail. A clamping width as distance between the first workpiece abutment element and the second workpiece abutment element can be set by positioning the first rail and the second rail relative to each other.

The clamping tool engages the first bracket and the second bracket and clamps these to each other. The clamping of the first workpiece abutment element and the second workpiece abutment element to one or more workpieces lying between the first workpiece abutment element and the second workpiece abutment element is thereby achieved. An extension of the clamping width of the clamping tool is, in effect, achieved; the clamping tool need only have the clamping width for clamping the first bracket and the second bracket. The total clamping width with which one or more workpieces are then acted upon is the distance between the first workpiece abutment element and the second workpiece abutment element. The first bracket and the second bracket, which are clampable to each other, are force-introducing elements via which the clamping force of the clamping tool can be introduced into the extending device. The forces that are introduced are transmitted via the first rail and the second rail to the workpiece abutment elements. The forces can be passed out there in order to clamp one or more workpieces between the workpiece abutment elements.

It is expedient for the first rail and the second rail to be aligned parallel to each other. A mounting and guidance for displacement on both the first bracket and the second bracket are thereby achieved in a simple way. In particular, the first bracket and the second bracket can then be of the same design, so that the number of components required is minimized.

It is further expedient for the first rail and the second rail to be positioned next to each other at least over a portion thereof. This results in a simple and compact structure.

A distance between the first workpiece abutment element and the second workpiece abutment element is determined by the position to which the first rail and the second rail are displaced relative to the first bracket and the second bracket. These positions are adjustable, and, therefore, the clamping width is also adjustable.

It is provided that the first bracket and the second bracket are positioned between the first workpiece abutment element and the second workpiece abutment element. A "clamping width extension" is thereby achieved. The clamping width required for clamping the first bracket and the second bracket is smaller than the resulting clamping width of the extending device with which one or more workpieces are clampable.

In particular, an order of sequence is first workpiece abutment element, first bracket, second bracket, second workpiece abutment element. The aforementioned elements follow one after the other.

It is expedient for the first bracket to comprise at least one guide opening via which the first rail and the second rail are mounted for sliding displacement on the first bracket. A mounting, in particular, a mounting for sliding displacement, of the respective rail (in particular, second rail) on the first bracket is thereby achieved in a simple way. Furthermore, a blocking of the first bracket relative to the first rail is achieved in a simple way.

For the same reason it is expedient for the second bracket to comprise at least one guide opening via which the first rail and the second rail are mounted for sliding displacement on the second bracket. A mounting of the first rail for sliding displacement on the second bracket is thereby achieved. Furthermore, a blocking of the movability of the second rail on the second bracket is achieved.

In particular, the at least one guide opening of the second bracket and the at least one guide opening of the first bracket are orientated in alignment with each other. As a result, the device for extending the clamping width can be constructed in a simple and compact way. The first bracket and the second bracket can then basically be of the same design, so that the number of components required is minimized.

It is quite particularly advantageous for the first rail to comprise at least one blocking element which by abutting on the second bracket prevents the second bracket from being able to become detached from the first rail. The second bracket is thereby secured against loss.

In particular, the at least one blocking element is arranged at or in the proximity of an end of the first rail that faces away from the first workpiece abutment element. A maximization of the clamping width is thereby achievable.

It is then similarly expedient for the second rail to comprise at least one blocking element which by abutting on the first bracket prevents the first bracket from being able to become detached from the second rail. The first bracket is thereby secured against loss.

To obtain a large clamping width it is expedient for the at least one blocking element to be arranged at or in the proximity of an end of the second rail that faces away from the second workpiece abutment element.

In an advantageous embodiment, the first workpiece abutment element has an aperture by means of which an end of the second rail is able to be brought behind the first workpiece abutment element. An arrangement is thereby achieved, in which the end of the second rail is followed by the first workpiece abutment element and then the first bracket. A clamping width is thereby obtainable, which is smaller than the length of the second rail (less a corresponding length of the second workpiece abutment element). The device for extending the clamping width is, therefore, designed for variable use, and clamping widths can be infinitely set, which range from the sum width of the first bracket and the second bracket to almost the sum length of the first rail and the second rail less the sum width of the first bracket and the second bracket.

In particular, the aperture is a through-opening through which the second rail is adapted to extend. The second rail can then also be guided on the first workpiece abutment element if the clamping width is below a certain limit.

For the same reason it is expedient for the second workpiece abutment element to have an aperture by means of which an end of the first rail is able to be brought behind the second workpiece abutment element. When this end lies behind the second workpiece abutment element, the order of sequence is then end of the first rail, second workpiece abutment element, second bracket.

In a corresponding manner, this aperture is then advantageously a through-opening through which the first rail is adapted to extend.

It is expedient for the first rail and/or the second rail to be fluted on an upper side and/or lower side. A blocking effect is thereby achieved in a simple way in cooperation with a blocking device of the first bracket and the second bracket by canting of a corresponding blocking element (in particular, a blocking plate).

In a variant of an embodiment, a fixing device is arranged on the first workpiece abutment element for fixing the second rail to the first workpiece abutment element. For example, the fixing device is designed as clamping device. A clamped position of the extending device can thereby be secured.

For the same reason, a fixing device may be arranged on the second workpiece abutment element for fixing the first rail to the second workpiece abutment element.

It is quite particularly advantageous for the first bracket to have a blocking device by means of which the displacement of the first bracket away from the first workpiece abutment element on the first rail is blockable. Accordingly, the movement of the first bracket towards the second bracket is blockable by the blocking device. As a result, upon exerting a clamping force between the first bracket and the second bracket, the first workpiece abutment element and the second workpiece abutment element are clamped to one or more workpieces lying between these.

In particular, the blocking device is so designed that its blocking action is releasable. A clamped position can thus be released.

It is further expedient for the blocking device to be so designed that the second rail is freely displaceable on the first bracket, more particularly, in any position of the blocking device. This enables, upon exerting a clamping force on the first bracket and the second bracket, by means of which these are pressed towards each other, a corresponding displacement of the second rail in order to press the second workpiece abutment element against a workpiece.

It is further expedient for the blocking device to be so designed that it has no blocking effect for the movement of the first bracket towards the first workpiece abutment element. This results, for example, in a simple adjustability of the bracket position.

For the aforesaid reasons it is then advantageous for the second bracket to have a blocking device by means of which the movement of the second bracket away from the second workpiece abutment element on the second rail is blockable. In particular, the blocking device is so designed that its blocking action is releasable. It is then further advantageous for the blocking device to be so designed that the first rail is freely displaceable on the second bracket.

For the aforesaid reasons it is then also purposeful for the blocking device to be so designed that it has no blocking effect for the movement of the second bracket towards the second workpiece abutment element.

In a constructionally simple embodiment, the blocking device has a blocking plate with an opening through which the respective rail extends. A blocking of the movability of the corresponding rail at least in one direction is then achieved by correspondingly inclining the blocking plate. It is possible for both the first rail and the second rail to extend through the opening.

In particular, in a blocking position the blocking plate is so inclined towards the respective rail and in canted engagement with it that the corresponding movability of the respective rail is blocked. A blocking of the movability in one direction is thereby obtained in a simple way. The movability in the other direction is not blocked by this. The blocking position can be released in a simple way by altering the inclination.

It is further expedient for the blocking plate to be so arranged for movement on the respective bracket that its inclination towards the respective rail is adjustable. For example, the blocking plate is arranged for pivotal movement. A blocking position can be released in a simple way by adjusting the inclination and, in particular, by reducing an angular position with an acute angle to the corresponding rail.

It is expedient for the blocking plate to be acted upon by a spring, the force of which presses the blocking plate into a blocking position, and for the blocking plate to have to be moved against the force of the spring in order to release the blocking position. A blocking position is thereby automatically secured by the action of the spring. The spring force must be overcome in order to eliminate the blocking force.

In terms of construction and manufacturing technology it is expedient for the first opening to have a first region for the first rail and a second region for the second rail, and for that region which serves to block the movability of the corresponding rail to have smaller height dimensions. A compact structure is thereby obtained. Both the first rail and the second rail extend through the opening and by corresponding design of the blocking plate a blocking action is achieved for only one of the rails, while the other rail is freely movable relative to the respective bracket. In particular, the first rail is freely movable on the second bracket, and the second rail is freely movable on the first bracket. The blocking device on the first bracket acts upon the first rail, and the blocking device on the second bracket acts upon the second rail.

It is expedient for the first bracket to have a first abutment surface, and for the second bracket to have a second abutment surface, with the first abutment surface and the second abutment surface facing away from each other. In a simple way, a clamping tool such as a clamp can then act upon the first bracket and the second bracket and clamp these to each other and hence bring about a clamping of the first workpiece abutment element and the second workpiece abutment element on one or more workpieces.

It is further expedient for the first workpiece abutment element to have a first abutment surface and for the second workpiece abutment element to have a second abutment surface, with the first abutment surface and the second abutment surface facing each other. One or more workpieces can then be clamped between the first abutment surface and the second abutment surface.

It is expedient for abutment surfaces of the first workpiece abutment element and the second workpiece abutment element and abutment surfaces of the first bracket and the second bracket to lie on different sides in relation to the rails. Consequently, the clampability of the first bracket and the second bracket on a clamping tool is not impeded by the abutment of the abutment surfaces of the workpiece abutment elements on one or more workpieces.

In an advantageous embodiment, the first bracket and the second bracket each have openings which are open on three sides and are orientated towards each other. In particular, the openings are open upwards (in a direction away from the rails) and open forwards and rearwards (in a direction parallel to a longitudinal direction of the rails). Consequently, a profiled rail or a slide rail of a clamping tool can be inserted into the openings. The clamping tool is thus secured at the sides against slipping when it exerts a clamping force on the first bracket and the second bracket.

In accordance with the invention, a combination of clamping tool and device for extending the clamping width is also provided. This comprises a clamping tool and a device according to the invention for extending the clamping width.

The clamping width of the clamping tool can be increased by the solution according to the invention.

In particular, the clamping tool is a clamp. Different clamps such as screw clamps, lever clamps, one-hand-operable clamps, etc. may be used.

It is expedient for the clamping tool to be operable with one hand. With one-hand-operability, the necessary clamping force can be exerted with one hand by, for example, a lever being operated with one hand. This makes it easy to use.

The following description of preferred embodiments serves to explain the invention in greater detail in conjunction with the drawings.

DETAILED DESCRIPTION OF THE INVENTION

Figure 1:
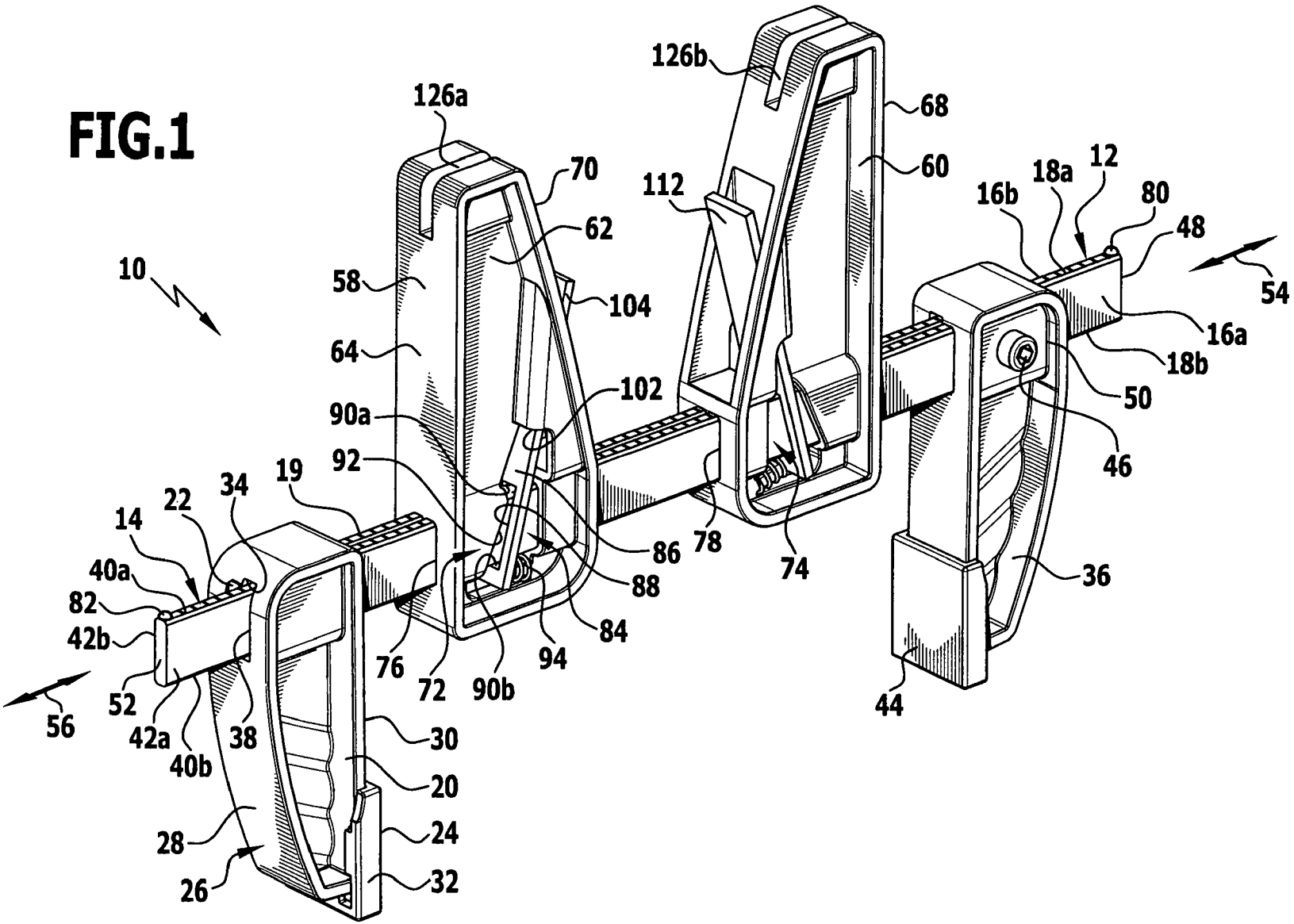
FIG. 1 shows a perspective representation of an embodiment of a device according to the invention for extending the clamping width.
Figure 2:
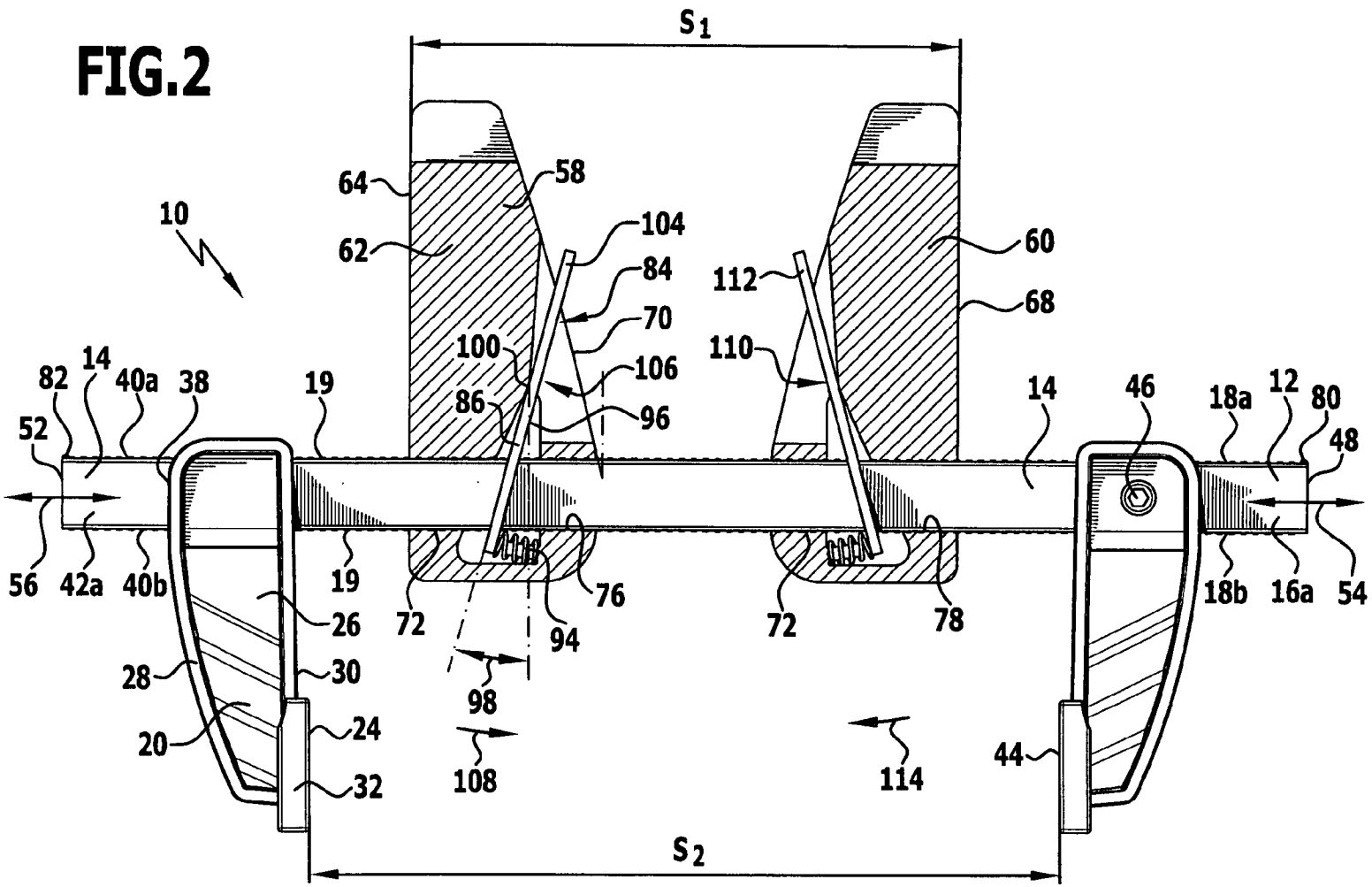
FIG. 2 shows a sectional view of the device according to FIG. 1 for extending the clamping width.
Figure 3:
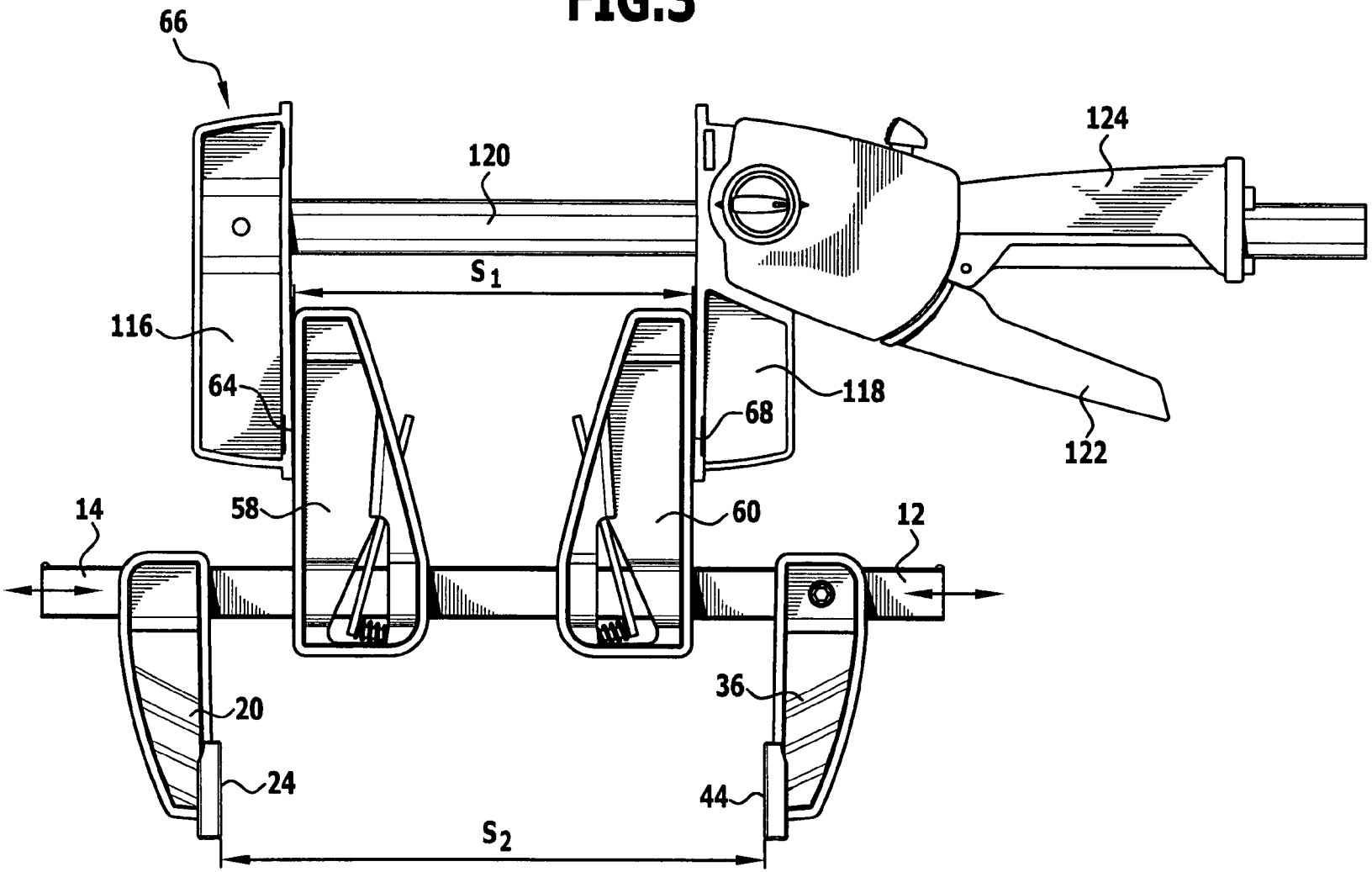
FIG. 3 shows the device according to FIG. 1 for extending the clamping width with a clamping tool positioned thereon.

An embodiment of a device according to the invention for extending the clamping width, shown in FIGS. 1 to 3 and designated therein by reference numeral 10, comprises a first rail 12 and a second rail 14. The first rail 12 and the second rail 14 are basically of the same design. They have a cross section which has an essentially rectangular envelope. The first rail 12 and the second rail 14 each have opposed broad sides 16*a*, 16*b* and opposed narrow sides 18*a*, 18*b* (upper side and lower side) orientated transversely and, in particular, vertically thereto. In one embodiment, they have a fluting 19 on each of the narrow sides 18*a*, 18*b*. The first rail 12 and the second rail 14 each extend in a longitudinal direction, to which the broad sides 16*a*, 16*b* and the narrow sides 18*a*, 18*b* run parallel. The first rail 12 and the second rail 14 are straight.

The first rail 12 and the second rail 14 are made, in particular, from a metallic material. They serve as slide rails, as will be explained in greater detail hereinbelow.

A first workpiece abutment element 20 is fixed to the first rail 12. In principle, it is possible for the fixing to be releasable, so that the fixed position of the first workpiece abutment element 20 on the first rail 12 is adjustable. Preferably, the first workpiece abutment element 20 is fixed at or in the proximity of a first end 22 of the first rail 12.

The first workpiece abutment element 20 serves for abutment on a workpiece. It is of bracket-shaped construction and projects with a first abutment surface 24 for a workpiece away from the narrow side 18*b*. If the narrow side 18*a* is regarded as upper side and the narrow side 18*b* as lower side of the first rail 12, then the first workpiece abutment element 20 projects with the first abutment surface 24 downwards.

The first workpiece abutment element 20 is made of, for example, a plastic material. It comprises an abutment element body 26 which has a bent outer side 28. An opposed inner side 30 is, in particular, of flat construction. Arranged on the inner side 30 is an abutment portion 32 on which the first abutment surface 24 is formed. The abutment portion 32 is, for example, pushed onto the abutment element body 26.

An aperture 34 is formed on the abutment element body 26. The first rail 12 extends in this aperture and is fixed to the first workpiece abutment element 20. A corresponding fixing device described further on in conjunction with the fixing of a second workpiece abutment element 36 to the second rail 14 is provided for this purpose.

The abutment element body 26 has a further aperture 38 which, in particular, is constructed as through-opening. The second rail 14 is adapted to extend through this aperture 38 and to be guided on the first workpiece abutment element 20. The aperture 38 serves for mounting the second rail 14 for sliding displacement on the first workpiece abutment element 20.

The aperture 34 by means of which the first rail 12 is fixed to the first workpiece abutment element 20 and the aperture 38 for guiding the second rail 14 lie parallel next to one another.

The second rail 14 is positioned parallel to the first rail 12. It also has narrow sides 40*a* (upper side) and 40*b* (lower side). The narrow side 40*a* is arranged in alignment with the narrow side 18*a* of the first rail 12. The narrow side 40*b* is arranged in alignment with the narrow side 18*b*. Furthermore, the second rail 14 has broad sides 42*a*, 42*b* which run substantially parallel to one another and parallel to the broad sides 16*a*, 16*b* of the first rail 12.

The second workpiece abutment element 36 is basically of the same design as the first workpiece abutment element 20. It has a second abutment surface 44 which faces the first abutment surface 24. A connecting line between the first abutment surface 24 and the second abutment surface 44 lies parallel to the first rail 12 and to the second rail 14.

The second workpiece abutment element 36 is fixed to the second rail 14 by means of a fixing device 46. This comprises, for example, a clamping screw by means of which the second rail 14 is clampable to an abutment element body of the second workpiece abutment element 36.

The second workpiece abutment element 36 also has apertures corresponding to the apertures 34 and 38. The second workpiece abutment element 36 is arranged mirror-symmetrically with the first workpiece abutment element 20 in relation to a center plane. Accordingly, the apertures 34 and 38 on the first workpiece abutment element 20 are arranged mirror-symmetrically with the corresponding apertures on the second workpiece abutment element 36.

The first rail 12 is adapted to extend through an aperture on the second workpiece abutment element 36 corresponding to the aperture 38. If it extends through this, it projects with a second end 48 facing away from the first end 22 beyond the second workpiece abutment element 36, i.e., projects behind this. Consequently, the second workpiece abutment element 36 is then arranged between the first end 22 and the second end 48 of the first rail 12. The corresponding aperture is of such construction that the first rail 12 can be pulled out of the corresponding aperture on the second workpiece abutment element 36. Depending on the position of the first rail 12 and the second rail 14 in relation to one another, the first rail 12 extends through or does not extend through the second workpiece abutment element 36.

The second rail 14 is fixed at or in the proximity of a first end 50 on the second workpiece abutment element 36. (In principle, the fixing may be releasable, so that the position of the second workpiece abutment element 36 on the second rail 14 is alterable.) With a second end 52 located opposite the first end 50, the second rail 14 can extend through the aperture 38 on the first workpiece abutment element 20. This position is shown in FIG. 1. In this case, the first workpiece abutment element 20 lies between the first end 50 and the second end 52 of the second rail 14.

It is also possible, depending on the position of the first rail 12 and the second rail 14 relative to each other, for the second rail 14 to project out of the aperture 38 of the first workpiece abutment element 20 and to lie between the first workpiece abutment element 20 and the second workpiece abutment element 36.

In the event the first rail 12 extends in the corresponding aperture of the second workpiece abutment element 36, the latter forms a slide bearing for the first rail 12. In the event the second rail 14 extends in the aperture 38 of the first workpiece abutment element 20, the latter forms a bearing for the second rail 14.

The first rail 12 is linearly displaceable in a direction of displacement/opposite direction 54 relative to the second workpiece abutment element 36 and on (if it extends in it) the second workpiece abutment element 36. This direction 54 is parallel to the longitudinal direction of the first rail 12 (and the second rail 14).

Furthermore, this direction 54 is transverse and, in particular, vertical to the first abutment surface 24 and the second abutment surface 44. The second rail 14 is linearly displaceable in a direction of displacement/opposite direction 56 relative to the first workpiece abutment element 20 and on (if it extends in it) the first workpiece abutment element 20. This direction 56 is parallel to the direction 54 or coincides with it.

Arranged, in a variant of an embodiment, on the first workpiece abutment element 20 is a fixing device by means of which the second rail 14 is releasably fixable (not shown in the drawings) to the first workpiece abutment element 20. For example, the fixing device is constructed as clamping device. By means of this, a certain position of the second rail 14 relative to the first workpiece abutment element 20 or a certain position of the first workpiece abutment element 20 and, in particular, a clamped position, can be secured. Alternatively or additionally, it is also possible for a fixing device to be arranged on the second workpiece abutment element 36 to releasably fix the first rail 12 on the second workpiece abutment element 36, in particular, in order to secure a clamped position.

Arranged on the first rail 12 and the second rail 14 are a first bracket 58 and a second bracket 60. The first bracket 58 and the second bracket 60 are positioned between the first workpiece abutment element 20 and the second workpiece abutment element 36. The order of sequence is first workpiece abutment element 20, first bracket 58, second bracket 60, second workpiece abutment element 36 in relation to a longitudinal direction of the first rail 12 or the second rail 14.

The first bracket 58 and the second bracket 60 are force-introducing elements. Via these, a force and, in particular, a clamping force can be introduced by means of a clamping tool. This introduced force, which is transmitted via the first rail 12 to the second rail 14, can then be passed out via the workpiece abutment elements 20 and 36 to one or more workpieces in order to clamp these.

The first bracket 58 is formed by a bracket body 62. The second bracket 60 is basically of the same design as the first bracket 58 and is arranged mirror-symmetrically with the first bracket 58. The bracket body 62 of the first bracket 58 and the second bracket 60 is preferably made of a plastic material.

The first bracket 58 has a first abutment surface 64 for a clamping tool 66 (FIG. 3). The second bracket 60 has a second abutment surface 68 for the clamping tool 66. The first abutment surface 64 and the second abutment surface 68 face away from each other. The first abutment surface 64 faces the first end 22 of the first rail 12. The second abutment surface 68 of the second bracket 60 faces the first end 50 of the second rail 14.

The first abutment surface 64 and the second abutment surface 68 are preferably of flat construction.

With their respective bracket body 62, the first bracket 58 and the second bracket 60 extend on a side, in relation to the first rail 12 and the second rail 14, that faces away from that side in which the first workpiece element 20 and the second workpiece element 36 extend. The first abutment surface 64 and the second abutment surface 68 lie on a different side than the first abutment surface 24 and the second abutment surface 44 of the first workpiece abutment element 20 and the second workpiece abutment element 36. Accordingly, the first abutment surface 64 and the second abutment surface 68 lie on an upper side of the device 10 for extending the clamping width if that side on which the first abutment surface 24 and the second abutment surface 44 lie is a lower side.

The first abutment surface 64 and the second abutment surface 68 lie transversely and, in particular, at least approximately vertically, to the first rail 12 and the second rail 14. On a side 70 opposite the respective abutment surface 64, 68, the first bracket body 58 and the second bracket body 60 are of inclined configuration, and this side lies at an acute angle to the first rail 12 or the second rail 14, which is, for example, in the order of magnitude of between 10° and 20°.

The first bracket 58 has a first bearing device 72 for slidable mounting of the first rail 12 and the second rail 14. In a corresponding manner, the second bracket 60 has a second bearing device 74 for slidable mounting of the first rail 12 and the second rail 14. (The bearing devices 72, 74 may also be seen as slide bearing devices for slidable mounting of the first bracket 58 and the second bracket 60 on the first rail 12 and the second rail 14.)

To form the first bearing device 72, the first bracket 58 has a guide opening 76 through which the first rail 12 and the second rail 14 extend. In a corresponding manner, the second bracket 60 has a guide opening 78 through which the first rail 12 and the second rail 14 also extend. In the described embodiment, a common guide opening 76 is provided on the bracket body 62 of the first bracket 58 for the first rail 12 and the second rail 14. The guide opening 78 on the second bracket 60 is of the same design as the guide opening 76 on the first bracket 58. It is also possible for separate guide openings to be provided for the first rail 12 and the second rail 14.

A blocking element 80 is arranged on the first rail 12 at or in the proximity of the second end 48. This is formed, for example, integrally on the rail 12 by an elevation. The blocking element is so designed that upon striking the second abutment surface 68 of the second bracket 60, it blocks the further movability of the first rail 12 with respect to the second bracket 60 towards the first bracket 58. As a result, the first rail 12 cannot be drawn completely through the guide opening 78 of the second bracket 60 and cannot extend completely out of it. The second bracket 60 is thereby prevented from being pulled off the first rail 12, and the second bracket 60 is secured against loss on the first rail 12.

The aperture on the second workpiece abutment element 36 corresponding to the aperture 38 is so configured that the first rail 12 can be pushed through with the blocking element 80, i.e., the blocking element 80 does not abut on the first workpiece abutment element 20.

The aperture on the second workpiece abutment element 36 which corresponds to the aperture 34 and via which the second workpiece abutment element 36 is fixedly secured to the second rail 14 may have smaller height dimensions (between the narrow sides 40*a* and 40*b*) than the aperture corresponding to the aperture 38 so as to enable a firm holding of the second workpiece abutment element 36 on the second rail 14.

In a corresponding manner, the second rail 14 has a blocking element 82 which extends beyond the narrow side 40*a* to such an extent that, when the blocking element 82 abuts on the first abutment surface 64 of the first bracket 58, a further sliding displacement of the first bracket 58 and the second rail 14 (in relation to a direction of movement of the first bracket 58 away from the second bracket 60) is blocked. The first bracket 58 is thereby secured against loss.

As explained hereinabove in conjunction with the second workpiece abutment element 36, the aperture 38 is so configured that the second rail 14 can extend fully with the blocking element 82 through the aperture 38.

The first bracket 58 and the second bracket 60 each have a blocking device 84 by means of which the displaceability of the first bracket 58 and the second bracket 60 in a certain direction is blockable. The blocking devices 84 of the first bracket 58 and the second bracket 60 are basically of the same design, and the blocking directions are opposed to each other. By means of the blocking device 84 of the first bracket 58, its movement towards the second bracket 60 on the first rail 12 and the second rail 14 parallel to the direction 54 or 56 is blockable. By means of the corresponding blocking device of the second bracket 60, its movement towards the first bracket 58 along the direction 54 or 56 is blockable. The blocking device 84 is so configured that the blocking is releasable. The respective bracket 58 or 60 is displaceable on the first rail 12 and the second rail 14 without any blocking action (blocking effect) in the direction opposite to the blocking direction.

The blocking device 84 comprises a blocking plate 86 which is arranged for movement and, in particular, pivotal movement on the bracket body 62 of the first bracket 58. The blocking plate 86 has an opening 88 configured as through-opening. The first rail 12 and the second rail 14 extend through this opening 88. The opening 88 is so configured that by means of the blocking plate 86 a blocking action is achievable for the movement of the first bracket 58 towards the second bracket 60, but the second rail 14 is freely displaceable (so long as the blocking element 82 does not abut on the first abutment surface 64) in each position of the blocking plate 86 on the first bracket 58. The opening 88 has a first region 90*a* and a second region 90*b* for this purpose. The first rail 12 extends through the first region 90*a*, and the second rail 14 extends through the second region 90*b*. The first region 90*a* has a smaller height than the second region 90*b*. The heights may be so selected that in a blocking position the blocking plate 86 is in canted engagement with the first rail 12 via its fluting 19 so as to block the movement of the first bracket 58 towards the second bracket 60. The second region 90*b* is so configured that irrespective of the position of the blocking plate 86, the second rail 14 is freely displaceable on the first bracket 58.

A channel is formed in the solid material of the bracket body 62 to produce to the guide opening 76. In the area of the blocking plate 86, this channel is open at the sides via an opening 92. As a result, the first rail 12 (and also the second rail 14) is not covered by channel walls in the area of the opening 92, and the blocking plate 86 can act upon the first rail 12.

The blocking plate 86 is acted upon by a spring. For this purpose, a pressure spring 94 is arranged beneath the first rail 12 and the second rail 14 on the first bracket 58. The pressure spring 94 is arranged, in relation to the first rail 12 and the second rail 14, on that side on which the first abutment surface 24 of the first workpiece abutment element 20 is also located.

The pressure spring 94 is aligned at least approximately parallel to the first rail 12 and the second rail 14. It exerts a pressing force on the blocking plate 86, by means of which the blocking plate 86 is pressed in a direction away from the second bracket 60 against an abutment region 96. This abutment region 96 is orientated obliquely at an acute angle to the longitudinal direction of the first rail 12 and the second rail 14. A typical order of magnitude of an angle 98 (FIG. 2), in which a blocking position is reached, is, for example, 15°. The angle depends upon the surface structure of a rail and the point at which the force is introduced.

In an abutment region 100, the blocking plate 86 abuts on the bracket body 62. Formed at the abutment region 100 in the bracket body 62 is a slot-shaped opening 102 through which the blocking plate 86 extends and projects beyond the side 70 of the first bracket 58. Via the projecting portion, the blocking plate 86 has an operative portion 104 to which an operator has access.

The blocking plate 86 is shown in a blocking position 106 in FIGS. 1 to 3. The blocking plate 86 is orientated at the angle 98 at an incline to the first rail 12 and is in canted engagement with it. The movement of the first bracket 58 towards the second bracket 60 is thus blocked. The second rail 14 is freely displaceable in relation to the first bracket 58.

To release the blocking position, the blocking plate 86 is moved and, in particular, pivoted towards the first bracket 58 by pressing on the operative portion 104. As a result, the blocking plate 86 moves in the area of the opening 88 in a pivoting direction 108 (FIG. 2). The canting of the blocking plate 86 on the first rail 12 is thereby released, and the first bracket 58 can be displaced on the first rail 12.

A blocking device of the second bracket 60 is basically of the same design as the blocking device 84, and this blocking device 110 of the second bracket comprises a blocking plate 112. This blocking plate 112 is designed in analogy with the blocking plate 86, and the blocking plate 112 has a corresponding opening which ensures that in a blocking position the blocking plate 112 is in canted engagement with the second rail 14, and the second bracket 60 is unable to move towards the first bracket 58. In each position of the blocking plate 112, the first rail 12 is freely movable. In a blocking position of the blocking plate 112, the blocking plate 112 is orientated at an angle of the same amount in relation to the second rail 14 as the blocking plate 86 in relation to the first rail 12. However, the sign of the angle is reversed. Accordingly, to release the blocking position, the blocking plate 112 must be pressed in the direction of the second bracket 60, which causes the corresponding opening to be pivoted in the pivoting direction 114, which is the opposite direction to the pivoting direction 108.

The blocking plates 86 and 112 are, for example, flat metal strips.

The device according to the invention for extending the clamping width operates as follows:

The clamping width $S_2$ of the device 10 for extending the clamping width is the distance between the first abutment surface 24 and the second abutment surface 44. This distance is set by the position of the first rail 12 and the second rail 14 relative to each other. The first rail 12 and the second rail 14 are mounted on both the first bracket 58 and the second bracket 60. These provide the corresponding slide bearings for mounting the first rail 12 and the second rail 14 for sliding displacement. The rails 12 and 14 are permanently mounted so as to lie next to each other on the first bracket 58 and on the second bracket 60. Owing to the blocking elements 80 and 82, the first rail 12 and the second rail 14 are unable to become detached from the first bracket 58 and the second bracket 60.

If the clamping width is below a minimum limit (distance between the first abutment surface 24 and the second abutment surface 44) the first rail 12 may also be guided for sliding displacement on the second workpiece abutment element 36 and/or the second rail 14 may be guided for sliding displacement on the first workpiece abutment element 20.

When the blocking position of the first bracket 58 and the second bracket 60 is set, the alteration of the clamping width is then carried out by setting the relative position of the rails 12 and 14, the distance between the first abutment surface 24 and the second abutment surface 44 being determined by the distance of the second end 48 of the first rail 12 from the second workpiece abutment element 36 and the distance of the second end 52 of the second rail 14 from the first workpiece abutment element 20.

The settability of the relative position between the first rail 12 and the second rail 14 can be impeded by the first bracket 58 and/or the second bracket 60 when the blocking element 82 abuts on the first bracket 58 and/or the blocking element 80 abuts on the second bracket 60.

The position of the first bracket 58 and the second bracket 60 is, in principle, freely adjustable on the first rail 12 and the second rail 14, the outer limits to the one side being the first workpiece abutment element 20 or the blocking element 82, depending on whether the first workpiece abutment element 20 or the blocking element 82 lies closer to the first bracket 58, and to the other side the second workpiece abutment element 36 or the blocking element 80, depending on whether the workpiece abutment element 36 or the blocking element 80 lies closer to the second bracket 60.

The position of the first bracket 58 and the second bracket 60 relative to each other and hence the distance $S_1$ (taken as the distance between the first abutment surface 64 and the second abutment surface 68) is, in principle, optionally adjustable within the aforesaid limits. The movement of the first bracket 58 towards the second bracket 60 is blocked and the movement of the second bracket 60 towards the first bracket 58 is blocked by the respective blocking device 84 and 110 when these are in their respective blocking position.

In one embodiment, the blocking devices 84 and 110 are so configured that the movement of the first bracket 58 away from the second bracket 60 and the movement of the second bracket 60 away from the first bracket 58 are not blocked.

The clamping tool 66 can engage the first bracket 58 and the second bracket 60 with a clamping width $S_1$ (FIG. 3). The clamping width $S_1$ may be smaller and, in particular, considerably smaller than the clamping width $S_2$. (For illustrative reasons, $S_2$ is shown only slightly larger than $S_1$ in the Figures.) In the solution according to the invention, a larger ratio of $S_2$ to $S_1$ is achievable than that shown. In a concrete embodiment, a maximum clamping width $S_2$ of approximately 1.80 m is achievable with a minimum clamping width $S_1$ of approximately 10 cm. An "extension transmission ratio" in the order of magnitude of 20 is thereby obtained.

The first abutment surface 24 and the second abutment surface 44 are placed against one or more workpieces which are to be clamped together. To do so, the first rail 12 and the second rail 14 (guided via the first bracket 58 and the second bracket 60) are displaced relative to each other such that the workpiece or workpieces is or are clamped between the first workpiece abutment element 20 and the second workpiece abutment element 36. The first bracket 58 and the second bracket 60 are brought into position (or have previously been brought into position) on the first rail 12 and the second rail 14. Via a first abutment element 116 of the clamping tool 66, which is placed against the first abutment surface 64 of the first bracket 58, and a second abutment element 118 of the clamping tool 66, which is placed against the abutment surface 68 of the second bracket 60, a clamping force is exerted, which endeavors to move the first bracket 58 and the second bracket 60 relative to and towards each other. The second workpiece abutment element 36 is pressed by this clamping force against a workpiece. Upon movement of the second bracket 60 towards the first bracket 58, the second rail 14 with the second workpiece abutment element 36 fixed thereto is taken along if the blocking device 110 is in its blocking position. Via a movement of the first bracket 58 towards the second bracket 60 the first rail 12 with the first workpiece abutment element 20 is also taken along by the clamping force, and the first workpiece abutment element 20 is pressed against a workpiece. By securing the clamped position of the clamping tool 66 the clamped position of the first workpiece abutment element 20 and the second workpiece abutment element 36 is secured.

Owing to the relative movement of the first bracket 58 and the second bracket 60 towards each other being blocked, a clamping force that has been introduced (with the brackets 58 and 60 as force-introducing elements) can be passed through the intermediary of the first rail 12 and the second rail 14 by the workpiece abutment elements 20 and 36 onto one or more workpieces.

The clamping tool 66 is, in particular, a clamp. This may comprise a slide rail 120 on which the second abutment element 118 is guided for sliding displacement. A corresponding mechanism ensures provision of the clamping force.

It is advantageous for the clamping tool 66 to be designed as a one-hand-operable clamp which is actuatable with one hand with a hand grip 122 for actuation of the clamping force.

In the embodiment shown, the clamping tool 66 has a counter grip 124 which is orientated at least approximately along the slide rail 120. The slide rail 120 may be mounted for sliding displacement on the counter grip 124.

Such a clamping tool is described in DE 10 2004 013 066 B4, to which reference is explicitly made. Furthermore, a corresponding clamping tool is shown in Community designs Nos. 000300009-0001 to -0008.

It may be provided that the first bracket 58 and the second bracket 60 each have a slot-shaped opening 126*a*, 126*b*. The profiled rail and, in particular, slide rail 120, of the clamping tool 66 may be placed in these slot-shaped openings 126*a*, 126*b*, which extend from the respective abutment surface to the opposite side 70. The clamping tool 66 is thereby secured against slipping sideways. (A position in which the slide rail 120 is not placed in the openings 126*a*, 126*b* is shown in FIG. 3.)

The invention claimed is:

1. Device for extending the clamping width for a clamping tool, comprising:

a first rail to which a first workpiece abutment element is fixed;

a second rail to which a second workpiece abutment element is fixed;

a first bracket on which the first rail and the second rail are mounted for sliding displacement; and a second bracket on which the first rail and the second rail are mounted for sliding displacement;

wherein the first bracket and the second bracket serve for engagement of the clamping tool thereon.

2. Device for extending the clamping width in accordance with claim 1, wherein the first rail and the second rail are aligned parallel to each other.

3. Device for extending the clamping width in accordance with claim 1, wherein the first rail and the second rail are positioned next to each other at least over a portion thereof.

4. Device for extending the clamping width in accordance with claim 1, wherein a distance between the first workpiece abutment element and the second workpiece abutment element is determined by the position to which the first rail and the second rail are displaced relative to the first bracket and the second bracket.

5. Device for extending the clamping width in accordance with claim 1, wherein the first bracket and the second bracket are positioned between the first workpiece abutment element and the second workpiece abutment element.

6. Device for extending the clamping width in accordance with claim 5, wherein the order of sequence is first workpiece abutment element, first bracket, second bracket, second workpiece abutment element.

7. Device for extending the clamping width in accordance with claim 1, wherein the first bracket comprises at least one guide opening via which the first rail and the second rail are guided for sliding displacement on the first bracket.

8. Device for extending the clamping width in accordance with claim 1, wherein the second bracket comprises at least one guide opening via which the first rail and the second rail are guided for sliding displacement on the second bracket.

9. Device for extending the clamping width in accordance with claim 8, wherein the at least one guide opening of the second bracket and the at least one guide opening of the first bracket are orientated in alignment with each other.

10. Device for extending the clamping width in accordance with claim 1, wherein the first rail comprises at least one blocking element which by abutting on the second bracket prevents the second bracket from being able to become detached from the first rail.

11. Device for extending the clamping width in accordance with claim 10, wherein the at least one blocking element is arranged at or in the proximity of an end of the first rail that faces away from the first workpiece abutment element.

12. Device for extending the clamping width in accordance with claim 1, wherein the second rail comprises at least one blocking element which by abutting on the first bracket prevents the first bracket from being able to become detached from the second rail.

13. Device for extending the clamping width in accordance with claim 12, wherein the at least one blocking element is arranged at or in the proximity of an end of the second rail that faces away from the second workpiece abutment element.

14. Device for extending the clamping width in accordance with claim 1, wherein the first workpiece abutment element has an aperture by means of which an end of the second rail is able to be brought behind the first workpiece abutment element.

15. Device for extending the clamping width in accordance with claim 14, wherein the aperture is a through-opening through which the second rail is adapted to extend.

16. Device for extending the clamping width in accordance with claim 1, wherein the second workpiece abutment element has an aperture by means of which an end of the first rail is able to be brought behind the second workpiece abutment element.

17. Device for extending the clamping width in accordance with claim 16, wherein the aperture is a through-opening through which the first rail is adapted to extend.

18. Device for extending the clamping width in accordance with claim 1, wherein at least one of the first rail and the second rail is fluted on at least one of an upper side and a lower side.

19. Device for extending the clamping width in accordance with claim 1, wherein a fixing device is arranged on the first workpiece abutment element for fixing the second rail to the first workpiece abutment element.

20. Device for extending the clamping width in accordance with claim 1, wherein a fixing device is arranged on the second workpiece abutment element for fixing the first rail to the second workpiece abutment element.

21. Device for extending the clamping width in accordance with claim 1, wherein the first bracket has a blocking device by means of which the displacement of the first bracket away from the first workpiece abutment element on the first rail is blockable.

22. Device for extending the clamping width in accordance with claim 21, wherein the blocking device is so designed that it's blocking action is releasable.

23. Device for extending the clamping width in accordance with claim 21, wherein the blocking device is so designed that the second rail is freely displaceable on the first bracket.

24. Device for extending the clamping width in accordance with claim 21, wherein the blocking device is so designed that it has no blocking effect for the movement of the first bracket towards the first workpiece abutment element.

25. Device for extending the clamping width in accordance with claim 1, wherein the second bracket has a blocking device by means of which the movement of the second bracket away from the second workpiece abutment element on the second rail is blockable.

26. Device for extending the clamping width in accordance with claim 25, wherein the blocking device is so designed that it's blocking action is releasable.

27. Device for extending the clamping width in accordance with claim 25, wherein the blocking device is so designed that the first rail is freely displaceable on the second bracket.

28. Device for extending the clamping width in accordance with claim 25, wherein the blocking device is so designed that it has no blocking effect for the movement of the second bracket towards the second workpiece abutment element.

29. Device for extending the clamping width in accordance with claim 21, wherein the blocking device has a blocking plate and an opening through which the respective rail extends.

30. Device for extending the clamping width in accordance with claim 28, wherein in a blocking position the blocking plate is so inclined towards the respective rail and in canted engagement with it that the corresponding movability of the respective rail is blocked.

31. Device for extending the clamping width in accordance with claim 29, wherein the blocking plate is so arranged for movement on the respective bracket that it's inclination towards the respective rail is adjustable.

32. Device for extending the clamping width in accordance with claim 29, wherein the blocking plate is acted upon by a spring which presses the blocking plate into a blocking position, and the blocking plate has to be moved against the force of the spring in order to release the blocking position.

33. Device for extending the clamping width in accordance with claim 29, wherein the opening has a first region for the first rail and a second region for the second rail, and that region which serves to block the movability of the corresponding rail has smaller height dimensions.

34. Device for extending the clamping width in accordance with claim 1, wherein the first bracket has a first abutment surface, and the second bracket has a second abutment surface, and the first abutment surface and the second abutment surface face away from each other.

35. Device for extending the clamping width in accordance with claim 1, wherein the first workpiece abutment element has a first abutment surface and the second workpiece abutment element has a second abutment surface, and the first abutment surface and the second abutment surface face each other.

36. Device for extending the clamping width in accordance with claim 1, wherein abutment surfaces of the first workpiece abutment element and the second workpiece abutment element and abutment surfaces of the first bracket and the second bracket lie on different sides in relation to the rails.

37. Device for extending the clamping width in accordance with claim 1, wherein the first bracket and the second bracket each have openings which are open on three sides and are orientated towards each other.

38. Combination of clamping tool and device for extending the clamping width, comprising a clamping tool and a device for extending the clamping width, the device for extending the clamping width comprising:

a first rail to which a first workpiece abutment element is fixed;

a second rail to which a second workpiece abutment element is fixed;

a first bracket on which the first rail and the second rail are mounted for sliding displacement; and a second bracket on which the first rail and the second rail are mounted for sliding displacement;

wherein the first bracket and the second bracket serve for engagement of the clamping tool thereon.

39. Combination of clamping tool and device for extending the clamping width in accordance with claim 38, wherein the clamping tool is a clamp.

40. Combination of clamping tool and device for extending the clamping width in accordance with claim 38, wherein the clamping tool is operable with one hand.

* * * * *